US007703695B2

(12) United States Patent
Young et al.

(10) Patent No.: US 7,703,695 B2
(45) Date of Patent: Apr. 27, 2010

(54) RAIL CLIP INSULATOR

(75) Inventors: Hartley Frank Young, Melton (AU); Jose Ricardo Mediavilla Prado, Kansas City, MO (US)

(73) Assignee: AirBoss Railway Products, Inc., Kansas City, MO (US)

( * ) Notice: Subject to any disclaimer, the term of this patent is extended or adjusted under 35 U.S.C. 154(b) by 68 days.

(21) Appl. No.: 11/575,587

(22) PCT Filed: Sep. 21, 2004

(86) PCT No.: PCT/AU2004/001280

§ 371 (c)(1),
(2), (4) Date: Feb. 4, 2008

(87) PCT Pub. No.: WO2006/032072

PCT Pub. Date: Mar. 30, 2006

(65) Prior Publication Data

US 2008/0203181 A1 Aug. 28, 2008

(51) Int. Cl.
*E01B 9/00* (2006.01)

(52) U.S. Cl. ..... 238/352; 238/349; 238/351

(58) Field of Classification Search ..... 238/310, 238/349, 351, 338, 343, 352
See application file for complete search history.

(56) References Cited

U.S. PATENT DOCUMENTS

| | | | | |
|---|---|---|---|---|
| 5,110,046 | A | 5/1992 | Young et al. | |
| 5,520,330 | A | 5/1996 | Brown et al. | |
| 5,551,633 | A | 9/1996 | Kish et al. | |
| 6,367,704 | B1 * | 4/2002 | Mediavilla | 238/310 |
| 6,572,027 | B1 * | 6/2003 | Pilesi et al. | 238/310 |
| 6,604,690 | B2 | 8/2003 | Young et al. | |

FOREIGN PATENT DOCUMENTS

| | | |
|---|---|---|
| FR | 2628455 | 9/1989 |
| WO | 93/12295 | 6/1993 |
| WO | 00/31343 | 6/2000 |
| WO | 02/31264 | 4/2002 |

* cited by examiner

*Primary Examiner*—Mark T Le
(74) *Attorney, Agent, or Firm*—Connolly Bove Lodge & Hutz LLP

(57) ABSTRACT

A two-part rail clip insulator (40, 50) for a tie and rail seat assembly that enables the seat to be pre-assembled at the rail tie fabrication plant into a preloaded position where a rail (2) may be laid on the tie (5) on site, the clips (30) being movable to the loaded position after the rail is placed in position. The rail seat includes a concrete rail tie (5), a pair of rail clip support shoulders (10) cast in place in the tie (5), each shoulder (10) having a rail face between its external sides, a pair of shoulder insulators (50) each shaped to lie against the rail face of the rail shoulder, a pair of rail clips (30) each having a base section (31) adapted to seat within the support shoulder (10) and a toe section adapted to seat on the rail base; the arrangement being such that when the rail clip is in the preloaded position, the toe insulator (40) and the toe (36) of the clips do not project beyond the face of the shoulder insulator (50), so that a rail (2) can be laid between the rail shoulders and their associated insulators (50). The toe insulator (40) is shaped to facilitate loading of the rail clip (30) and resist movement of the clip or the rail during use.

4 Claims, 7 Drawing Sheets

RAIL CLIP INSULATOR

This application is the National Stage of International Application No. PCT/AU2004/001280 filed on Sep. 21, 2004; the entire contents are hereby incorporated by reference.

TECHNICAL FIELD

This invention relates to a rail fastening assembly of the type where a rail is clamped to a rail seat by elastic rail fasteners held in shoulders fastened to the tie and insulators isolate the rail fastener and support shoulders from the rail. The present invention addresses problems associated with the insulators.

BACKGROUND

Concrete ties have been in use in some parts of the world for a long time but it is only since 1985 that they have been able to provide cost benefits for use in North America relative to wooden ties.

One advantage of concrete ties is that the rail seats can be pre assembled with only a few components to be added on site when the rail is placed in position. The difficulty with this is that the pre assembled components can become dislodged during transport and some components still have to be positioned on the rail. The rail seats usually comprises a rail pad that is positioned below the rail, an abrasion resistant plate below the pad, rail clip support shoulders on the field and gauge sides of the rail, an elastic rail clip that seats in the support shoulder and bears down on the rail base and an insulator that lies between the rail and the rail clip and the support shoulder. The support shoulders are precast in the rail tie and the rail pad is fitted between each pair. Because the rail clips and insulators contact the rail when fastened they cannot be placed in position until the rail has been placed in position on the rail seat. Rail seat assemblies of this type have been generally described in U.S. Pat. Nos. 5,110,046, 5,551,633 and 6,604,690. The rail clips in these assemblies are either installed or loose and therefore had to be assembled on site. U.S. Pat. No. 6,367,704 proposed using a modified support shoulder so that the clip could be partially installed for transport purposes where it was retained on the shoulder and then able to be fully installed when the rail was placed in position. In this arrangement the insulators still needed to be placed in position manually before the clip could be fully installed. The insulator is a one piece assembled part that lies on the rail flange to separate the rail from the clip and extends down between the rail flange and the support shoulder to provide insulation between the shoulder and the rail.

U.S. Pat. No. 5,520,330 discloses a bent rod rail clip with a two part insulator that enables the rail seat to be pre-assembled at the tie plant.

WO02/31264 discloses a rail clip that has an insulator encapsulating the toe of the rail clip that lies on the rail flange to avoid the need to insert the insulator separately.

It is an object of this invention to provide a rail clip insulator that enables easier assembly of a rail seat without compromising rail fastening performance.

SUMMARY OF THE INVENTION

To this end the present invention provides a railroad tie and rail seat assembly for supporting a rail which includes a) a concrete rail tie b) a pair of rail clip support shoulders cast in place in said rail tie each said shoulder having a rail face between its external sides, a clip gateway through said rail face, a rail clip ramp leading from the rear of the shoulder and terminating in the clip gateway at substantially the level of the rail base;

c) a rail pad seated on said rail tie between said support shoulders d) a pair of shoulder insulators each shaped to lie against the rail face of the rail shoulder;

e) a pair of rail clips each having a base section adapted to seat within the rail clip support shoulder and a toe section adapted to seat on the rail base, the toe section comprising a pair of bifurcated arms extending from said base section and being bent in a curve so that the toes lie adjacent but beyond the base f) a pair of toe insulators each adapted to fit about the toe of the rail clip to insulate the clip from the rail base g) the arrangement being such that when the rail clip has a first stable position in the shoulder the toe insulator where the toe of the clip sits does not project beyond the face of the shoulder insulator so that a rail can be laid between the rail shoulders and their associated insulators and a second stable position where the toe insulator and the toes of the rail clip lie on the rail base.

This arrangement enables the rail seat to be preassembled in such a way that all the components are held in place on the tie during transport from the tie production plant to the railway installation site. Once the rail is placed in position on the tie, the clips are simply pushed onto the rail base to secure the rail. In the preloaded, transport position the base of the clip is only partially inserted into the clip recess of the support shoulder. This is made possible by replacing the conventional rail insulator with two insulators one being attachable to the support shoulder to insulate the shoulder from the rail and the other being attachable to the rail clip to insulate the clip from the rail. The shoulder insulator encloses the rail face of the support shoulder and provides insulation between the rail base and the support shoulder in a direction substantially normal to the rail tie. The shoulder insulator has end portions extending along the sides of the shoulder to locate and retain the shoulder insulator on the shoulder. The shoulder insulator also includes a gate similar in shape to the shoulder gate for the rail clip and toe insulator to pass through.

The toe insulator functions like a sled and the forward wall is radiussed to enable the insulator to ride over the leading edge of the rail base and up the inclined surface of the rail base. The toe insulator incorporates a recess for each toe portion with sufficient room to enable the bifurcated arms to be squeezed together as they pass through the guideway of the shoulder. The toe insulator is dimensioned relative to the support shoulder so that in the preload position the toe insulator does not project beyond the rail face of the support shoulder any further than the post insulator so that the rail can be placed onto the rail seat without disturbing the prefitted components. Once the rail is in place the clips and the associated toe insulators can be pushed on to the rail base to the fully loaded or installed position.

In a preferred embodiment the toe insulator is dimensioned so that the rear end of the toe insulator is close to the clip base so that as the rail clip toes deflect backwards when the insulator begins to climb the rail base, the clip base contacts the rear of the toe insulator and helps to push the toe insulator onto the rail. This avoids excess force being applied to the front of the insulator by the clip toes to avoid the risk of the insulator breaking or rolling over. The rear base portion of the of the toe insulator preferably incorporates a stepped portion dimensioned so that it lies adjacent the lip of the gate on the rail face of the shoulder when the clip is in the fully installed position. This step then engages the lip to resist any rearward movement of the insulator off the rail. The lower part of the front face of the toe insulator is radiussed with a radius of at least 3 mm to enable the insulator to ride over the leading edge of the rail base.

When the clip and toe insulator are in the fully loaded position the rear end of the insulator preferably remains within the gateway of both the shoulder and the shoulder insulator, so that any axial movement of the rail will cause the toe insulator to contact the sides of the shoulder and shoulder insulator gates and consequently provide a creep resisting force. Without this resistance the sideward creep force would be resisted by the clip which is flexible in that direction and the available creep resisting force provided by the clip is lower than that provided by the shoulder which is rigidly fixed to the rail tie. The shoulder insulator is rigidly attached to the shoulder so that sideways force applied to this insulator is transmitted directly to the shoulder. This feature of the clip and toe insulator increases resistance of the total assembly to the effects of rail creep.

While this invention is primarily aimed at providing benefits for original track installations it also gives ongoing benefits for track maintenance. When the rail and pads need to be changed it is a simple matter to move the clip and toe insulator back into the first stable position for removal of the rail & then to press the clip and toe assemblies back into the second stable position on the rail base when the replacement is complete.

DETAILED DESCRIPTION OF THE INVENTION

A preferred embodiment of the invention will now be described with reference to the drawings in which FIG. 1 is a detail of a side elevation illustrating one embodiment of this invention;

Figure 1:
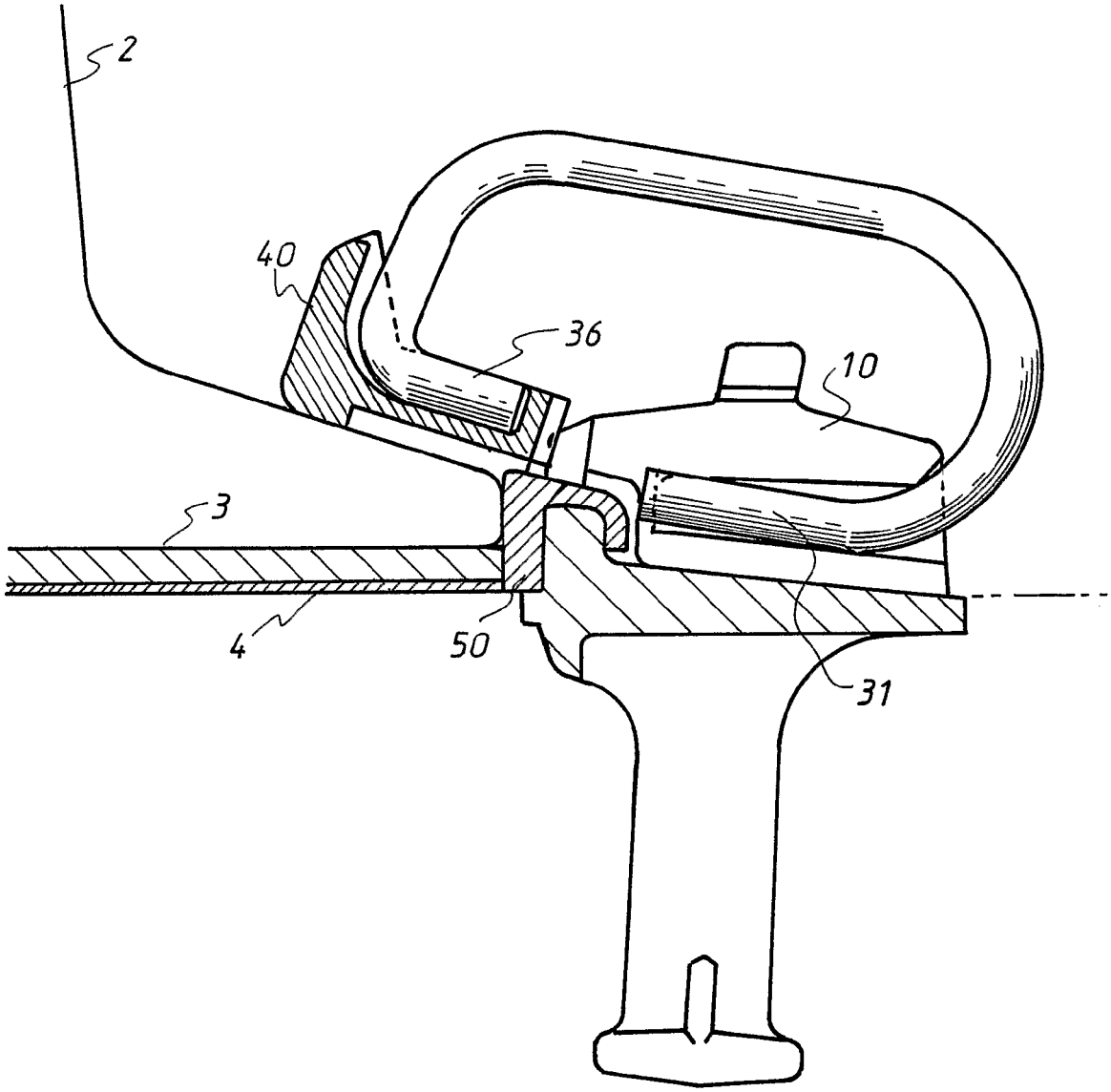

The rail seat comprises a concrete rail tie 5 into which has been cast the rail clip support shoulders 10. Between the two shoulders 10 are positioned a rail pad 3 and beneath that a wear resisting plate 4. The rail 2 seats on the rail pad 3. This rail pad may incorporate a recess at its edge adjacent the shoulder 10 to accommodate a deep post insulator 50. The rail pad is preferably as described in Australian specification 2004201448. The base 31 of rail clip 30 is securely held within the shoulder 10 and the toe section 32 seats within the toe insulator 40 that lies on the rail base 2. The deep post insulator 50 is attached to shoulder 10 and lies between the rail base 2 and the shoulder 10 and extends down to the rail pad 3.

Figure 2:
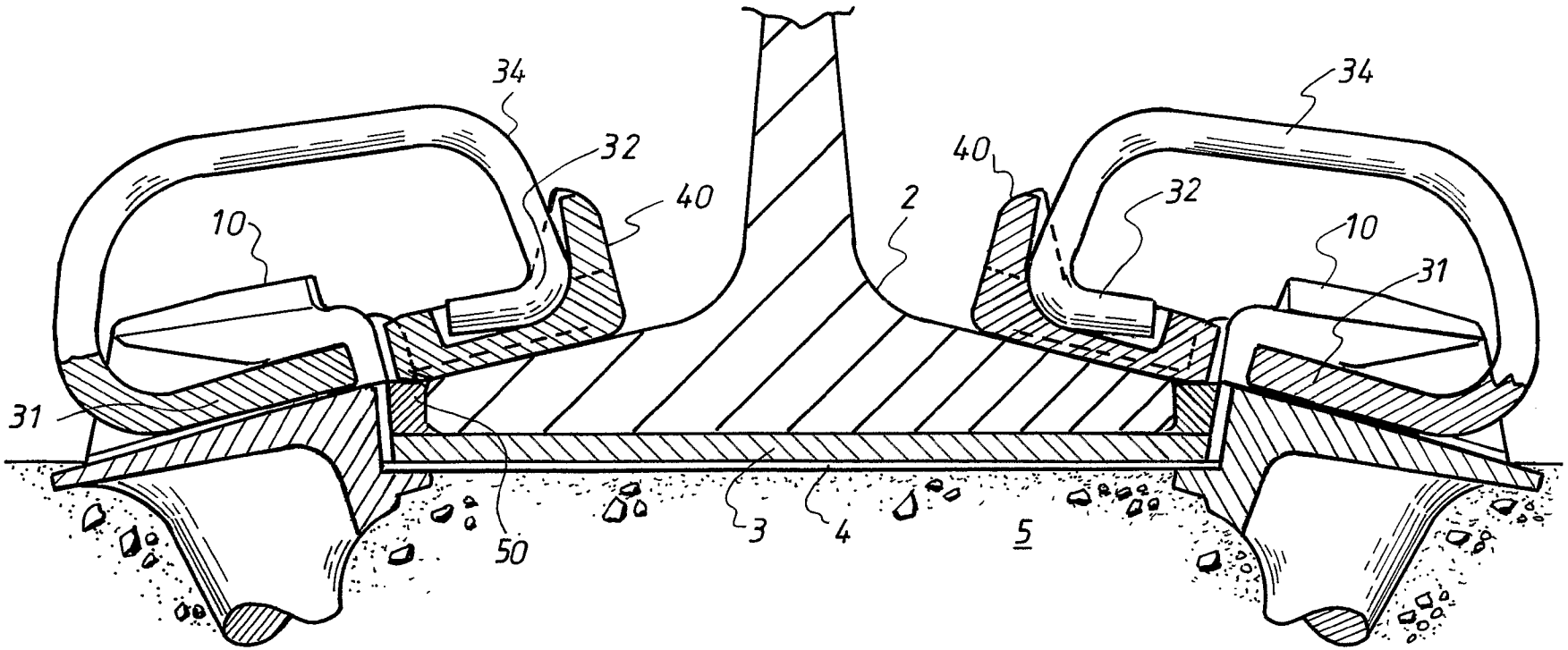
FIG. 2 is a side elevation of a typical rail seat of this invention showing a rail clip in the loaded position.

The rail clip 30 as illustrated in FIGS. 1 and 2 is made from a flat metal stamping bent into its final 3 dimensional state. The rail clip consists of a base web 31 which bifurcates into arms 34 that end in the toe portions 32. The ends 36 of the toe portion 32 are shaped to enable to clips to be held in a partially applied position in the shoulder 10. The rail clip and shoulder are designed so that the clip has two stable positions in the shoulder namely a preloaded position where a rail can be placed in position on the rail seat and a fully loaded position in which the toes of the rail clip are on the rail base.

The toe insulator 40 shown in FIGS. 1 and 2 is conceptually like a sled encapsulating the toe portion 32 of clip 30. The toes 32 of the clip enter the toe insulator 40 vertically and provide a downward force on the insulator 40. The insulator 40 has a front wall 41 with sides 41A shaped to pass through the gate 12 of the shoulder 10 and the gate 52 Of the shoulder insulator 50. The lower front wall 45 is angled to assist the insulator to ride up the rail base 2 particularly when the tie is lower than the final position. The lower surface 46 is flat to provide maximum contact area with the rail base 2. The rear of the base 47 is upwardly inclined to assist in the movement of the insulator. The toes 32 of the clip, seat in the toe recesses 42 formed by the centre web 43 that extends between the front wall 41 and the rear wall 44. This web 43 reinforces the toe insulator and strengthens the front and rear walls to ensure that the insulator 40 can withstand the forces applied during installation of the clip onto the rail base. As the clip is moved forward the insulator 40 is pushed forward by the radiussed portion of the clip toe 32 abutting the forward wall 41 of the insulator 40. And when the clip 30 is retracted the free end of the toe 32 abuts the rear wall 44 and the insulator 40 moves rearwardly with the clip 30.

Figure 3:
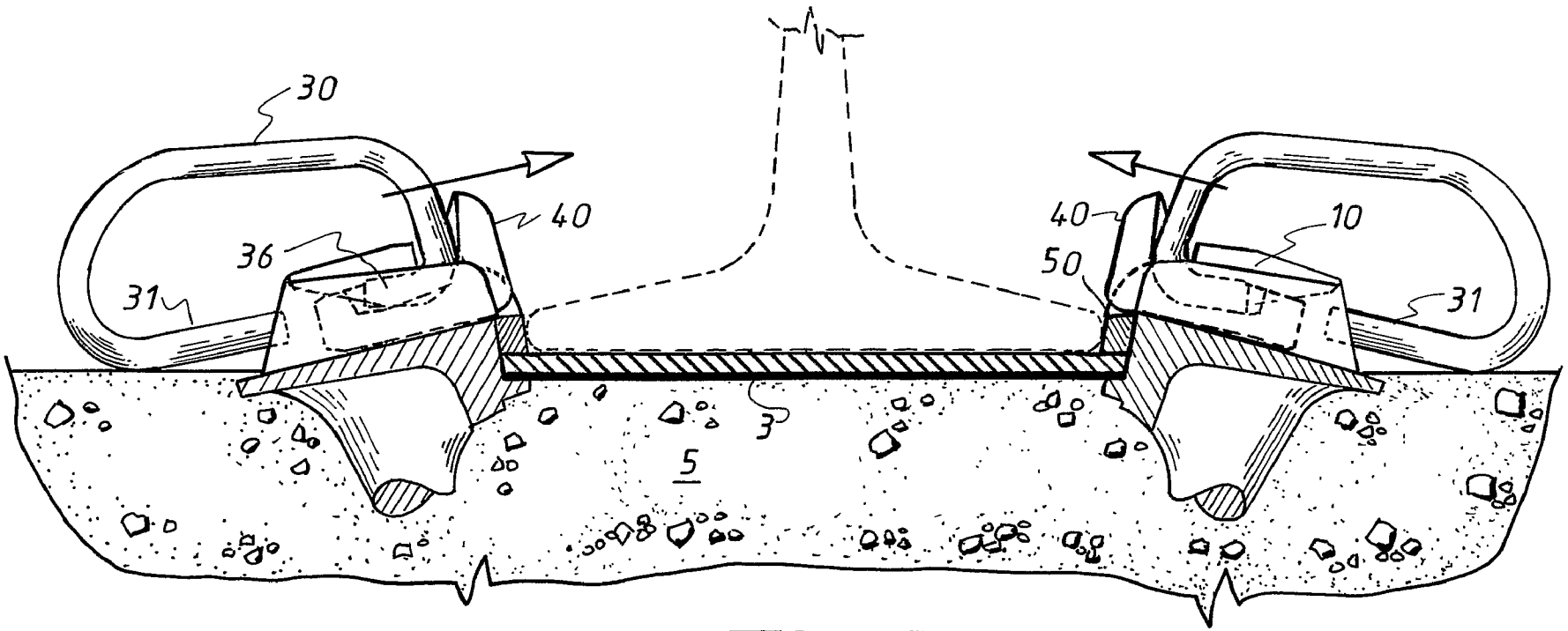
FIG. 3 is a side view of the assembly of FIG. 2 in a pre-loaded state.
Figure 6:
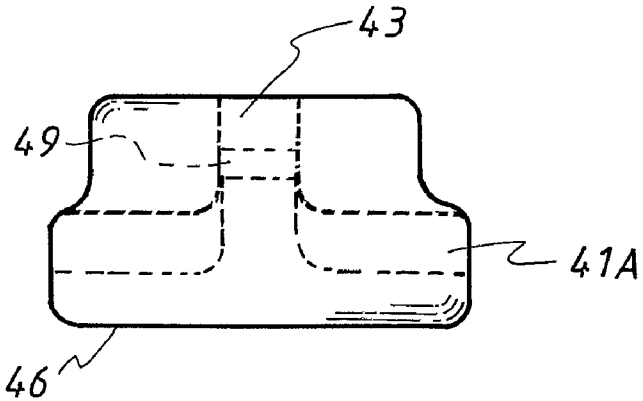
FIG. 6 is a front view of the second embodiment of the toe insulator shown in FIG. 4.
Figure 7:
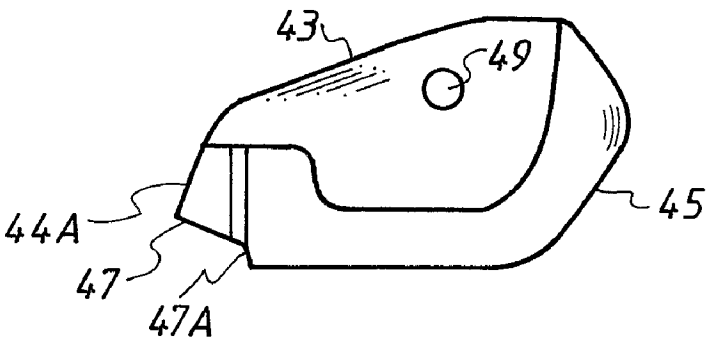
FIG. 7 is a side view of the second embodiment of the toe insulator shown in FIG. 4.
Figure 4:
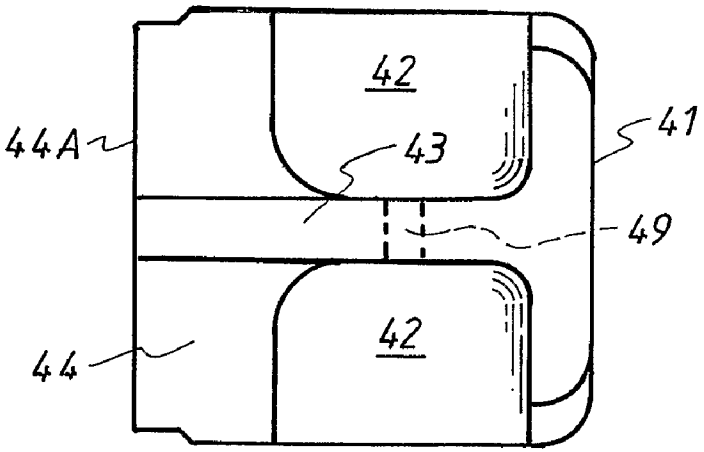
FIG. 4 is a plan view of the second embodiment of the toe insulator of this invention.
Figure 5:
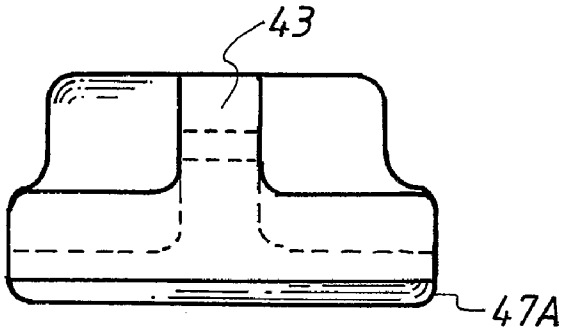
FIG. 5 is a rear view of the second embodiment of the toe insulator shown in FIG. 4.

The two part insulator in combination with the clip and shoulder of this invention enables the rail seat to be preassembled at the concrete tie plant as shown in FIG. 3. The clip is in the preloaded position and the insulator 40 is locked in by the toes 32 and the insulator 50 is attached to the rail face of shoulder 10 by the insulator end projections 51 and the rail pad and shoulder insulator are secured in position. The base 31 of the clip has entered the clip slot in the shoulder 10. In this preassembled position the rail tie can be transported without the risk of components being lost. On site once the tie is in position the rail can be moved into position and the only installation step needed is to push the clip toward the rail which takes the toe portion 32 of the clip and insulator 40 onto the rail base and the base of the clip 31 seats in its loaded position (FIG. 2) in shoulder 10 to secure the clip in place.

The angled base of the installed shoulder and the angle of the clip base in the shoulder are chosen so that the frictional engagement of the clip base keeps the clip located on the rail base.

Figure 8:
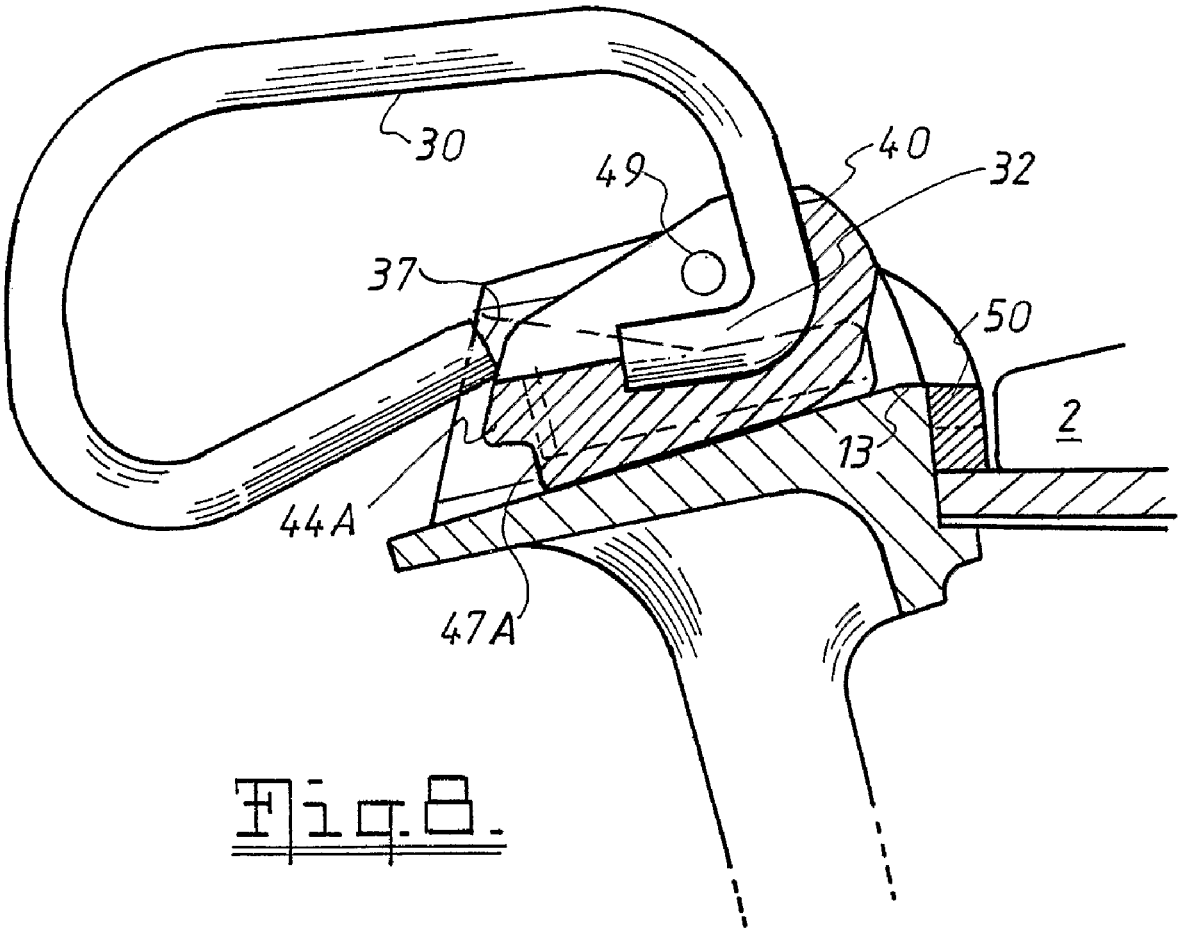
FIG. 8 illustrates the toe insulator of FIG. 4 during the loading of the clip into the shoulder.
Figure 9:
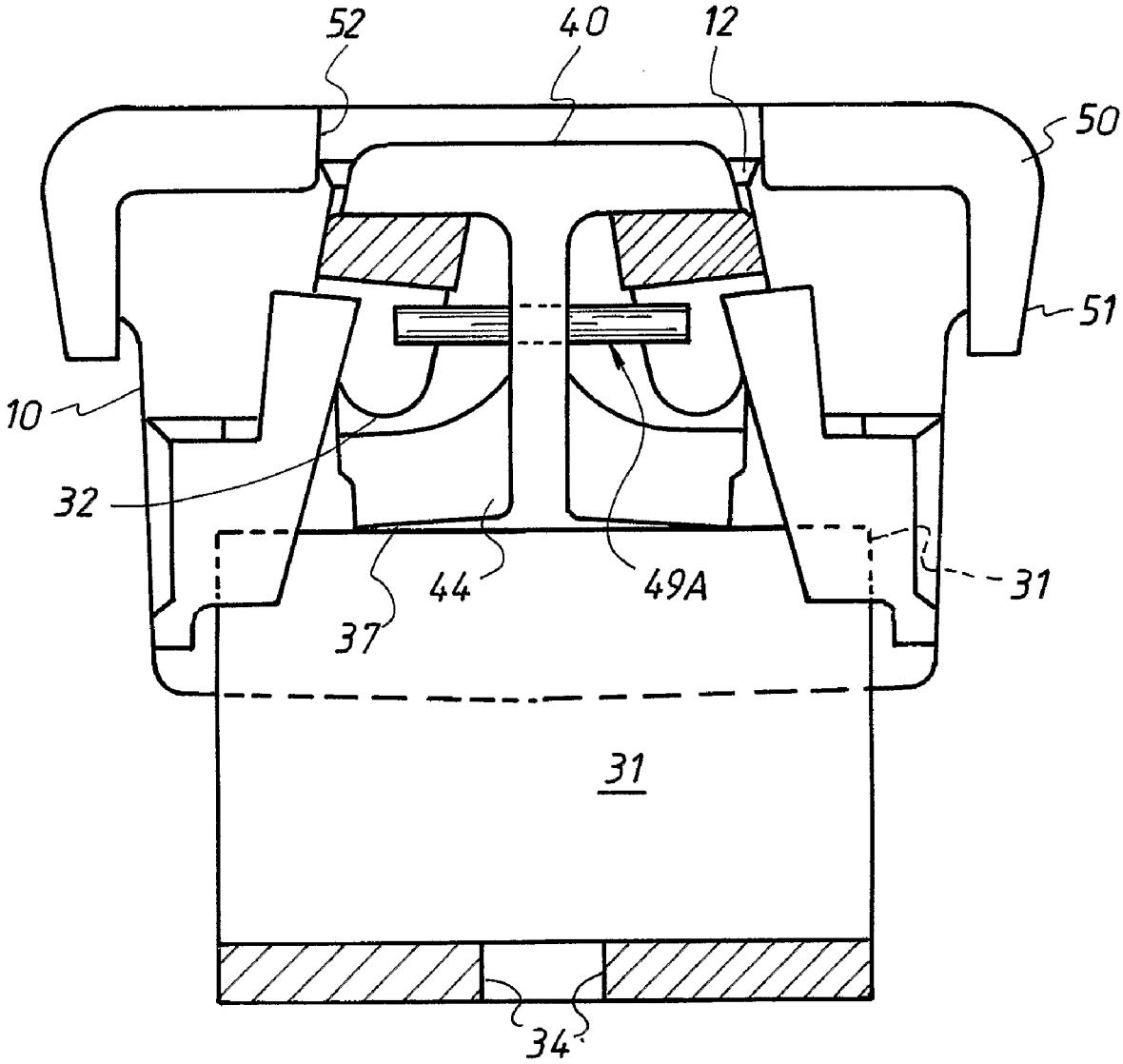
FIG. 9 is a plan view of one of the shoulders of FIG. 3 in the preloaded state with the toe insulator of FIG. 4.
Figure 10:
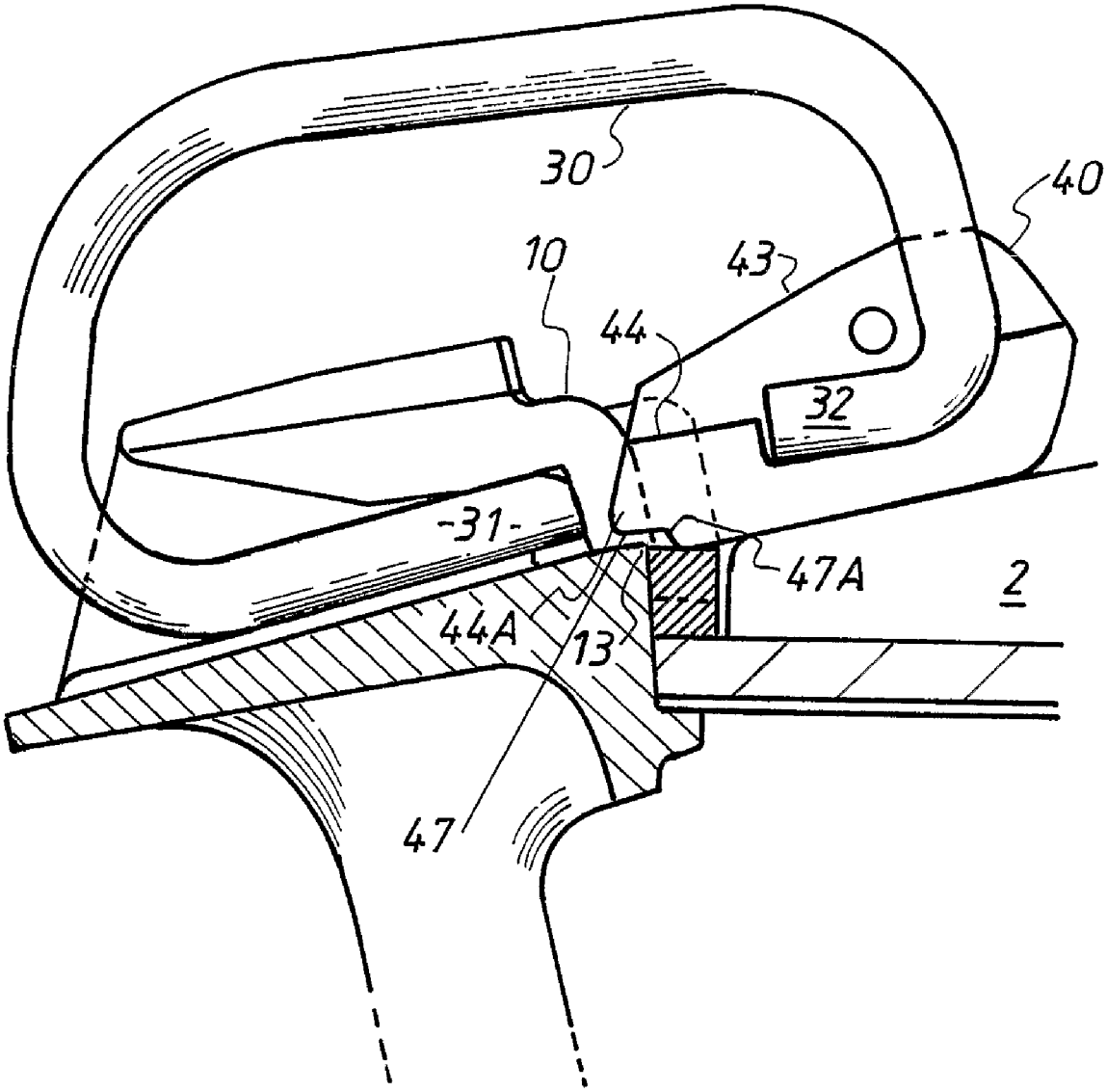
FIG. 10 is a side elevation the rail seat of FIG. 9 showing a rail clip in the installed position with the insulator of FIG. 7.

A second embodiment of the insulator is illustrated in FIGS. 4 to 10 of the drawings. This embodiment is designed for track installations where rail creep and clip withdrawal due to vibration of the rail seat are problems. The component parts are similar to those of the embodiment of FIGS. 1 to 3. The toe insulator of FIGS. 4 to 10 is longer as can be seen in FIGS. 8 to 10 by extending rear wall 44 and providing a projection 44A which is adapted to abut the end 37 of the base 31 of the rail clip 30. The clip base contacts the rear of the toe insulator and helps to push the toe insulator onto the rail. This avoids excess force being applied to the front of the insulator by the clip toes to avoid the risk of the insulator breaking or rolling over. The junction of the inclined front face 45 of insulator 40 and the flat base of insulator 40 is a radiused section of about 3 mm or more which assists the insulator in riding up onto the rail base particularly in situations where the rail tie is in a depression relative to the rail.

The toe insulator may optionally incorporate a hole 49 for a locking pin 49A which engages the toes 32 of the clip 30 so that the toe insulator 40 is retained on the toes 32 so that the clip and toe insulator can be assembled as a single component.

After installation of the clip on the rail base there may be a tendency under load for the clip and insulator to back out by moving off the rail base. As shown in FIG. 10 the step 47 A in the inclined rear base 47 is dimensioned so that if back out occurs, the step 47A abuts the lip 13 of the gate of shoulder 10 and the gate 52 of the shoulder insulator to resist any tendency of the clip 30 and the toe insulator 40 to move off the rail base 2 when the clip is in the installed position. Rail creep, where the rail tends to move longitudinally relative to the rail seat and drag the insulators with it, is resisted in this embodiment because the toe insulator 40 is longer and a portion of the rear wall 44 abuts the lateral internal wall of the gate of shoulder 10 and the gate of the shoulder insulator to transmit the creep load to the fixed shoulder. Without this the clip toes will deflect sideways & creep resistance will be significantly less then when this feature is used.

Those skilled in the art will realize that the present invention provides a rail tie assembly that is easy to fabricate and assemble and reduces the time and cost of installation. Although one particular embodiment has been described those skilled in the art will realize that variations and modifications may be made without departing from the core teachings of the invention.

The invention claimed is:

1. A railroad tie rail seat assembly for supporting a rail which includes:

a) a concrete rail tie rail seat and a rail lying across said rail seat;

b) a pair of rail clip support shoulders cast in place in said rail seat each said shoulder having a rail face between its external sides, and a rear side remote from said rail face, and a clip gateway through said rail face;

c) a rail pad on said rail seat between said support shoulders and beneath said rail;

d) said rail having a rail base with a leading edge adjacent the rail face of each support shoulder and a surface of said rail base being inclined upwardly in a direction away from said support shoulder;

e) a pair of shoulder insulators each shaped to lie against the rail face of the rail shoulder;

f) a pair of rail clips each having a base section adapted to seat within the rail clip support shoulder and a toe section adapted to seat on the rail base, the toe section comprising a pair of bifurcated arms extending from said base section and being bent in a curve so that the toes lie adjacent but beyond the clip base;

g) a pair of toe insulators each adapted to fit about the toe section of the rail clip to insulate the clip from the rail base and each consists of a body portion having a forward wall, a base section and a rear wall and a rear end;

h) each said toe insulator incorporating a recess for each arm of the toe section of the rail clip with sufficient width to enable the bifurcated arms of the rail clip to compress together as they pass through the gateway of the shoulder;

i) each said toe recess being defined by said forward wall and said rear wall which are abutted by the toe section of the rail clip so that the toe insulator moves with the rail clip;

j) a rail side of said forward wall of each said toe insulator is radiussed to enable the insulator to ride over said leading edge of said rail base and up an inclined surface of the rail base; and k) the arrangement of a rail tie, support shoulders, shoulder insulators, rail clip and toe insulators being such that the rail clip has a first stable position in the shoulder where the toe insulators do not project beyond the rail face of said shoulder insulator so that a rail can be laid between rail shoulders and respective shoulder insulators and a loaded position where the toe insulator and the toe section of the rail clip lie on the rail base.

2. A railroad tie rail seat assembly for supporting a rail which includes:

a) a concrete rail tie rail seat and a rail lying across said rail seat;

b) a pair of rail clip support shoulders cast in place in said rail seat each said shoulder having a rail face between its external sides, and a rear side remote from said rail face, and a clip gateway through said rail face;

c) a rail pad on said rail seat between said support shoulders and beneath said rail;

d) said rail having a rail base with a leading edge adjacent the rail face of each support shoulder and a surface of said rail base being inclined upwardly in a direction away from said support shoulder;

e) a pair of shoulder insulators each shaped to lie against the rail face of the rail shoulder;

f) a pair of rail clips each having a base section adapted to seat within the rail clip support shoulder and a toe section adapted to seat on the rail base, the toe section comprising a pair of bifurcated arms extending from said base section and being bent in a curve so that the toes lie adjacent but beyond the clip base;

g) a pair of toe insulators each adapted to fit about the toe section of the rail clip to insulate the clip from the rail base and each includes of a body portion having a forward wall, a base section and a rear wall and a rear end;

h) each said toe insulator incorporating a recess for each arm of the toe section of the rail clip with sufficient width to enable the bifurcated arms of the rail clip to compress together as they pass through the gateway of the shoulder;

i) each said toe recess being defined by said forward wall and said rear wall which are abutted by the toe section of the rail clip so that the toe insulator moves with the rail clip;

j) a rail side of said forward wall of each said toe insulator is radiussed to enable the insulator to ride over said leading edge of said rail base and up an inclined surface of the rail base; and k) the arrangement of a rail tie, support shoulders, shoulder insulators, rail clip and toe insulators being such that the rail clip has a first stable position in the shoulder where the toe insulators do not project beyond the rail face of said shoulder insulator so that a rail can be laid between rail shoulders and respective shoulder insulators and a loaded position where the toe insulator and the toe section of the rail clip lie on the rail base.

3. A railroad tie rail seat assembly as claimed in claim 2 in which the rear end of the toe insulator is adjacent or touching the base of the rail clip so that the rail clip base is able to assist in pushing the toe insulator onto the rail base.

4. A railroad tie rail set assembly as claimed in claim 2 in which the rear end of the toe insulator remains in the gateway of either or both the support shoulder and the shoulder insulator when the clip is in the loaded position with the toes of the clip over the rail base.

* * * * *